US007864018B2

(12) United States Patent
Giandalia et al.

(10) Patent No.: US 7,864,018 B2
(45) Date of Patent: Jan. 4, 2011

(54) PLANAR TRANSFORMER ARRANGEMENT

(75) Inventors: Marco Giandalia, Palermo (IT); Massimo Grasso, Trivolzio (IT); Marco Passoni, Pavia (IT)

(73) Assignee: International Rectifier Corporation, El Segundo, CA (US)

( * ) Notice: Subject to any disclaimer, the term of this patent is extended or adjusted under 35 U.S.C. 154(b) by 49 days.

(21) Appl. No.: 12/165,749

(22) Filed: Jul. 1, 2008

(65) Prior Publication Data

US 2008/0266043 A1 Oct. 30, 2008

Related U.S. Application Data

(62) Division of application No. 11/324,556, filed on Jan. 3, 2006, now Pat. No. 7,414,507, which is a division of application No. 10/452,679, filed on May 30, 2003, now Pat. No. 7,042,325.

(60) Provisional application No. 60/384,724, filed on May 31, 2002, provisional application No. 60/420,914, filed on Oct. 23, 2002.

(51) Int. Cl.
*H01F 5/00* (2006.01)

(52) U.S. Cl. ..... 336/200

(58) Field of Classification Search ..... 336/65, 336/83, 200, 206–208, 232, 180–184; 257/531; 363/153, 171; 323/243, 355
See application file for complete search history.

(56) References Cited

U.S. PATENT DOCUMENTS 4,012,703 A 3/1977 Chamberlayne (Continued)

FOREIGN PATENT DOCUMENTS

GB 2 083 952 3/1982

(Continued)

OTHER PUBLICATIONS

Department of Electronic Engineering, S. Tang, S. Hui and H. Chung, "A Low-Profile Power Converter Using Printed-Circuit Board (PCB) Power Transformer Shielded With Ferrite Polymer Composite" 2000 IEEE pp. 1-6.

(Continued)

*Primary Examiner*—Tuyen Nguyen
(74) *Attorney, Agent, or Firm*—Farjami & Farjami LLP

(57) ABSTRACT

A planar transformer arrangement and method provide isolation between an input signal and an output signal. The planar transformer arrangement includes a planar medium having a first layer, a second layer, and a dielectric interlayer arranged between the first and second layers; at least one meandering primary winding arranged on the first layer of the planar medium, a current flow being induced within the primary winding in accordance with the input signal; at least one meandering secondary winding arranged on the second layer of the planar medium, the primary and secondary windings forming a planar transformer, whereby a voltage is induced across the secondary winding in accordance with the current flow within the primary winding; and a mode elimination arrangement configured to produce a compensated voltage by compensating for a common mode interference on the voltage induced across the secondary winding, the mode elimination arrangement being further configured to generate the output signal in accordance with the compensated voltage; wherein the dielectric interlayer of the planar medium provides a voltage isolation between the primary and secondary windings.

18 Claims, 7 Drawing Sheets

U.S. PATENT DOCUMENTS

| | | | | |
|---|---|---|---|---|
| 4,201,965 | A | | 5/1980 | Onyshkevych |
| 4,238,723 | A | * | 12/1980 | Jenks ..... 323/322 |
| 4,494,100 | A | | 1/1985 | Stengel et al. |
| 5,319,342 | A | | 6/1994 | Kuroki |
| 5,353,001 | A | | 10/1994 | Meinel et al. |
| 5,406,468 | A | * | 4/1995 | Booth ..... 363/15 |
| 5,424,054 | A | | 6/1995 | Bethune et al. |
| 5,583,474 | A | | 12/1996 | Mizoguchi et al. |
| 5,598,327 | A | | 1/1997 | Somerville et al. |
| 5,659,461 | A | | 8/1997 | Inou et al. |
| 6,501,364 | B1 | | 12/2002 | Hui et al. |
| 6,696,910 | B2 | | 2/2004 | Nuytkens et al. |
| 7,706,161 | B2 | * | 4/2010 | Quazi ..... 363/89 |

FOREIGN PATENT DOCUMENTS

| | | |
|---|---|---|
| JP | 04-151810 | 5/1992 |

OTHER PUBLICATIONS

IEEE Transactions on Power Electronics, vol. 14, No. 3, May 1999 "Coreless Printed Circuit Board (PCB) Transformers for Power MOSFET/IGBT Gate Drive Circuits" pp. 422-430, S. Hui, H Chung and S. Tang.

Electronic Letters, May 28, 1998, vol. 34, No. 11,, pp. 1052-1054 "Coreless printed-circuit board transformers for signal and energy transfer."

* cited by examiner

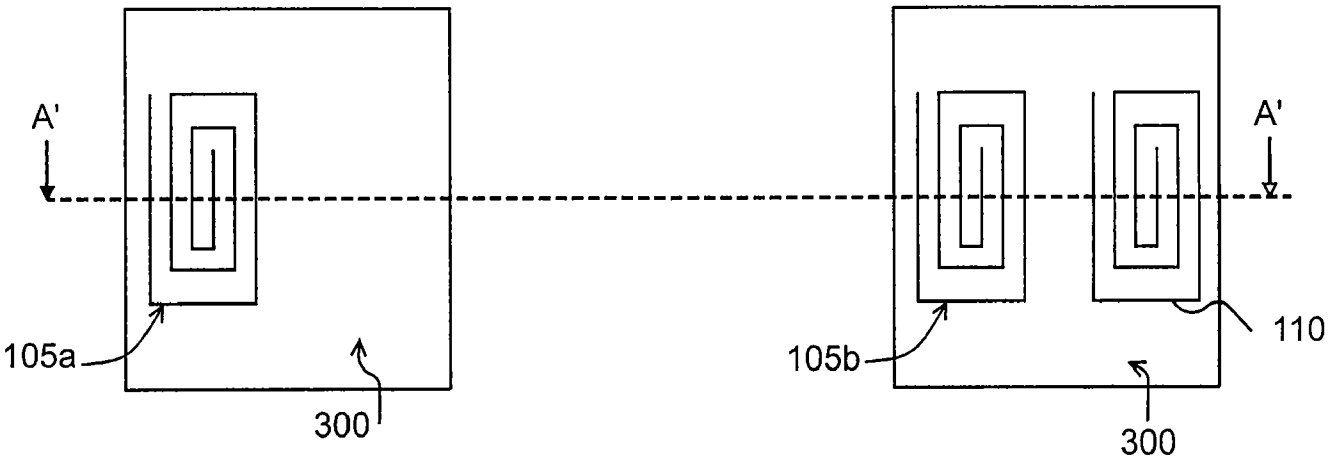
Figure 3b
Figure 3a
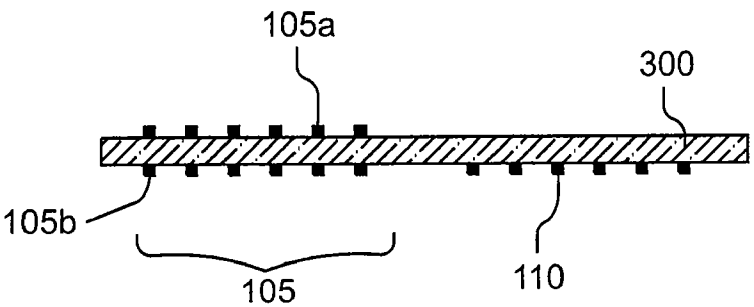
Figure 3c

PLANAR TRANSFORMER ARRANGEMENT

CROSS REFERENCE TO RELATED APPLICATIONS

The present application is a divisional of U.S. patent application Ser. No. 11/324,556 filed Jan. 3, 2006, entitled "PLANAR TRANSFORMER ARRANGEMENT," which is a divisional of U.S. patent application Ser. No. 10/452,679 filed May 30, 2003, entitled "PLANAR TRANSFORMER ARRANGEMENT," which is based on and claims priority to U.S. Provisional Patent Application Ser. No. 60/384,724 filed May 31, 2002, entitled "PLANAR TRANSFORMER AND DIFFERENTIAL TRANSCEIVER STRUCTURE," and U.S. Provisional Patent Application Ser. No. 60/420,914 filed Oct. 23, 2002, entitled "SWITCHING VOLTAGE REGULATOR FOR SWITCH MODE POWER SUPPLY WITH PLANAR TRANSFORMER," the entire contents of these applications being expressly incorporated herein by reference.

FIELD OF THE INVENTION

The present invention relates to a planar transformer arrangement and method for isolating driver circuitry and communication circuitry to eliminate magnetic field interference and parasitic capacitance.

BACKGROUND INFORMATION

Transformers are often used in floating gate driver circuits for driving high power/voltage switches, for example, high voltage IGBTs for motor control and other applications. In such an application, a transformer provides isolation between low voltage driver circuitry and high voltage power switch circuitry. Such transformers may also be employed to communicate data signals between electrically isolated circuits (e.g., to communicate signals via a transceiver).

Traditionally, high-voltage isolation has required the use of bulky transformers. However, such transformers may be costly, cumbersome, and all transformers may be negatively affected by unwanted common-mode noise, such as noise generated by parasitic capacitances and/or an external magnetic field.

Conventional transformers inherently exhibit two kinds of parasitic capacitances: distributed parasitic capacitances between adjacent windings on a transformer; and interwinding parasitic capacitances between primary and secondary windings of the transformer. These parasitic capacitances result from the close proximity between transformer windings. The magnetic core is generally arranged between the primary and secondary windings of the transformer, so that the magnetic field generated by the transformer may be better conducted. However, operation of the transformer may induce the flow of disadvantageous currents within the magnetic core, if the core, for example, contacts the transformer windings. These currents may result in a degradation of the galvanic insulation between primary and secondary windings.

Furthermore, an externally applied magnetic field may result in disadvantageous common mode magnetic interference within conventional transformers. Such a magnetic field may induce the flow of unwanted currents within the primary and/or secondary windings of the transformer. These common-mode currents may cause a magnetic flux to form around the conductors of the primary and/or secondary windings, thereby inducing noise within the windings.

SUMMARY OF THE INVENTION

It is an object of the present invention to overcome these disadvantages of conventional transformers. To achieve this object, the present invention provides for a planar transformer arrangement, comprising a plurality of meandering windings (e.g., circular or polygonal printed meandering windings) to be arranged on a planar medium (e.g., a printed circuit board or a general interlayer structure (e.g., metal-oxide-metal) of an integrated circuit), such that at least one primary winding of the planar transformer arrangement is provided on one layer (e.g., one side) of the planar medium (e.g., on one layer of a printed circuit board or on one metal layer of a integrated circuit), and at least one secondary winding of the planar transformer arrangement is provided on another layer (e.g., the other side) of the planar medium, the primary and secondary windings forming a planar transformer.

By arranging the planar transformer arrangement in this manner, a dielectric layer of the planar medium (e.g., the printed circuit board or a dielectric oxide layer of the integrated circuit) provides voltage isolation and an open magnetic path between the two primary and secondary windings of the planar transformer arrangement. The voltage isolation provided by the planar medium permits the present invention to be used, for example, in circuits that isolate a gate driver from high voltage IGBT power switches, which may operate at high voltages and at high currents.

In accordance with an exemplary embodiment of the present invention, the planar transformer arrangement includes a second planar transformer comprising at least one second primary winding provided on one layer (e.g., on one side) of the planar medium, and at least one second secondary winding provided on another layer (e.g., the other side) of the planar medium. By placing the two planar transformers in close proximity, a differential amplifier arrangement may be used to detect and compensate for common mode electromagnetic interference applied to the two planar transformers (e.g., to compensate for noise caused by an external magnetic field and/or parasitic capacitance between windings).

In accordance with still another exemplary embodiment of the present invention, the magnetic mode interference is canceled without using a differential amplifier circuit. For this purpose, each of the windings of the planar transformer includes two windings connected in anti-series. In this manner, magnetic common mode interference may be automatically canceled without need for external compensating circuitry, such as a differential amplifier circuit.

In accordance with yet another exemplary embodiment of the present invention, the electromagnetic coupling between the windings of the planar transformer arrangement is improved by providing a magnetic core, for example, a ferrite core, to couple the windings of the two planar transformers. The planar magnetic core may, for example, be applied over the windings of the respective planar transformers on both sides of the planar medium, respectively.

In accordance with still another exemplary embodiment of the present invention, two respective metallic shields are provided between the two windings and coupled respectively to primary and secondary ground voltages. In this manner, the shields help prevent interwinding parasitic capacitance from interfering with the planar transformers by operating to magnetically isolate the magnetic flux produced by the interwinding parasitic capacitance.

BRIEF DESCRIPTION OF THE DRAWINGS

FIGS. 3*a* through 3*c* are top, bottom, and cross-sectional views, respectively, of the exemplary planar transformer shown in FIG. 1.

DETAILED DESCRIPTION

Figure 1:
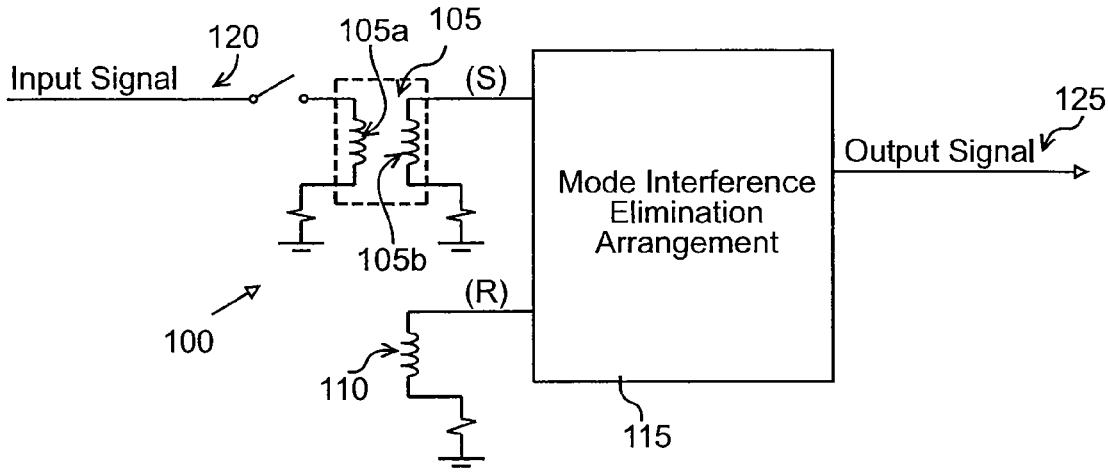
FIG. 1 is a block diagram of a first exemplary planar transformer arrangement according to the present invention.

Referring now to FIG. 1, there is seen a first exemplary planar transformer arrangement 100 according to the present invention. Planar transformer arrangement 100 includes a planar transformer 105 having primary and secondary windings 105*a*, 105*b* arranged on respective sides of a planar medium (not shown), e.g., a printed circuit board or an integrated circuit, a single mode detect winding 110 on the same side of the planar medium as the secondary winding 105*b*, a mode interference elimination circuit 115 electrically connected to the secondary winding 105*b* of the planar transformer 105 and the single mode detect winding 110.

The exemplary planar transformer arrangement 100 of FIG. 1 is operable to communicate an input signal 120 applied to the primary winding 105*a* of the planar transformer 105 to an output signal 125, while providing voltage isolation between the input signal 120 and the output signal 125. Specifically, an input signal 120 applied to the primary winding 105*a* of the planar transformer 105 induces a current flow within the primary winding 105*a*. The magnetic flux caused by the increasing current flow induces a voltage signal (S) across the secondary winding 105*b* of the planar transformer 105, which is then transmitted by the mode interference elimination circuit 115 as output signal 125.

Figure 2:
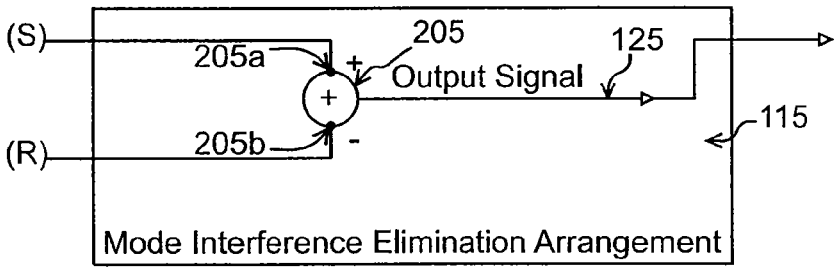
FIG. 2 is a block diagram of an exemplary mode interference elimination arrangement according to the present invention.

The mode interference elimination circuit 115 is also configured to prevent common mode magnetic noise interference from corrupting the signal flow between the input and output signals 120, 125. Referring now to FIG. 2, there is seen an exemplary mode interference elimination circuit 115 according to the present invention for eliminating a common mode magnetic interference caused by an externally applied magnetic field. Mode interference elimination circuit 115 includes a summation circuit 205 having a high impedance positive input 205*a* electrically connected to the voltage (S) across the secondary winding 105*b*, and a high impedance negative input 205*b* electrically connected to the voltage (R) across the mode detect winding 110.

If an external magnetic field is applied to the planar transformer arrangement 100, a common mode interference voltage will be superimposed on both the voltage (S) across the secondary winding 105*b* and the voltage (R) across the mode detect winding 110. However, since the interference voltage appears across both windings 105*b*, 110, the summation circuit 205 operates to cancel the interference voltage effects of the externally applied magnetic field, thereby generating the output signal 125 free of common mode interference.

Referring now to FIGS. 3*a* through 3*c*, there is seen top, bottom, and cross-sectional views, respectively, of the exemplary planar transformer 105 and exemplary mode detect winding 110 shown in FIG. 1. As shown in FIGS. 3*a* through 3*c*, the windings 105*a*, 105*b*, 110 of the exemplary planar transformer arrangement 100 may be implemented, for example, as meandering traces on a planar medium 300 (e.g., a printed circuit board or an integrated circuit), which forms an open magnetic path between the primary and secondary windings 105*a*, 105*b* of the planar transformer 105.

Figure 5:
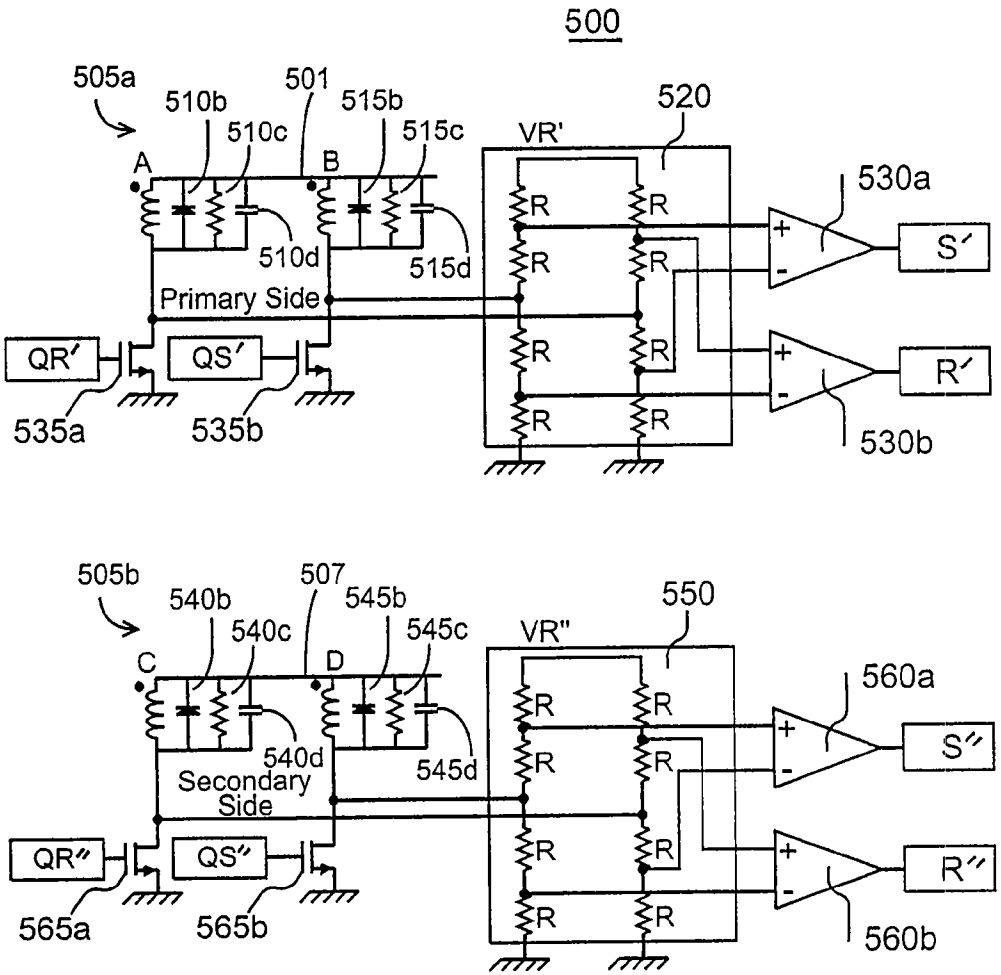
FIG. 5 illustrates another exemplary planar transformer arrangement according to the present invention, including a transceiver circuit to drive planar transformer.

Referring now to FIG. 5, there is seen a second exemplary planar transformer arrangement 500 according to the present invention. The planar transformer arrangement 500 includes primary circuitry 505*a* arranged on one side of a planar medium (not shown) and secondary circuitry 505*b* arranged on the other side of the planar medium (not shown).

In applications in which the planar medium is an integrated circuit, the primary and secondary circuitry 505*a*, 505*b* may be arranged on separate silicon dies or, alternatively, may be arranged on the same silicon die. If the primary and secondary circuitry 505*a*, 505*b* are arranged on separate dies, magnetic coupling between the circuitry 505*a*, 505*b* may be effected using two metal interconnection layers separated by a dielectric layer.

Planar transformer arrangement 500 is operable as an isolation transceiver to permit input signals (QR') and (QS') of primary circuitry 505*a* to be communicated as respective output voltage signals (R") and (S") of secondary circuitry 505*b*, and to permit input signals (QR") and (QS") of the secondary circuitry 505*b* to be communicated as respective output voltage signals (R') and (S') of primary circuitry 505*a*. In this manner, various signals may be communicated between the primary circuitry 505*a* and the secondary circuitry 505*b*, while maintaining electrical isolation.

For this purpose, primary circuitry 505*a* includes a primary winding (A) electrically connected to both the negative input terminal of a comparator 530*a* and the positive input terminal of a comparator 530*b* via resistor network 520, and a primary winding (B) electrically connected to both the positive input terminal of the comparator 530*a* and the negative input terminal of the comparator 530*b* via the resistor network 520. The first and second primary windings (A), (B) are also electrically connected in parallel to respective diodes 510*b*, 515*b*, resistors 510*c*, 515*c*, and capacitors 510*d*, 515*d*, all of which terminate at source voltage 501.

Secondary circuitry 505*b* includes a secondary winding (C) electrically connected to both the negative input terminal of a comparator 560*a* and the positive input terminal of a comparator 560*b* via resistor network 550, and a secondary winding (D) electrically connected to both the positive input terminal of the comparator 560*a* and the negative input terminal of the comparator 560*b* via the resistor network 550. The first and second secondary windings (C), (D) are also electrically connected in parallel to respective diodes 540*b*, 545*b*, resistors 540*c*, 545*c*, and capacitors 540*d*, 545*d*, all of which terminate at source voltage 502.

Figure 6A:
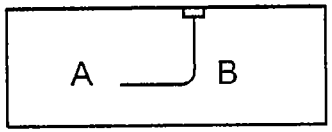
FIGS. 6*a* through 6*c* are top, bottom, and cross-sectional views of the exemplary planar transformer arrangement shown in FIG. 5.
Figure 6B:
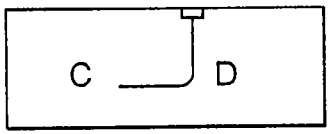
Figure 6C:
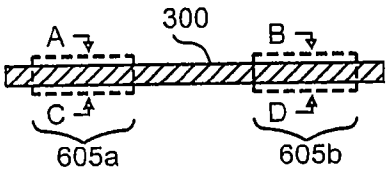

As shown in FIGS. 6*a* and 6*c*, each of the primary and secondary windings (A), (B), (C), (D) is implemented as a separate meandering trace on a planar medium 300 (e.g., a printed circuit board or integrated circuit), with primary windings (A), (B) being arranged on one layer (e.g., one side) of planar medium 300 and secondary windings (C), (D) being arranged on another layer (e.g., the other side) of planar medium 300. Specifically, primary winding (A) is arranged over secondary winding (C) to form a first planar transformer 605*a*, and primary winding (B) is arranged over secondary winding (D) to form a second planar transformer 605*b*, as shown in FIG. 6*c*.

In operation, if a pulsed input signal, for example, signal (QR'), is applied to the gate of FET 535*a* of primary circuitry 505*a*, a current will be induced within the primary winding (A). The magnetic flux caused by the increasing current flow induces a voltage across the secondary winding (C) of the first planar transformer 605*a*, which causes the comparator 560*b* of the secondary circuitry 505*b* to produce a positive output voltage signal (R").

If the primary windings (A), (B) and the secondary windings (C), (D) are arranged adjacent to one another on respective sides of the planar medium, common mode magnetic interference caused by an externally applied magnetic field will induce an interference voltage across both the secondary windings (C), (D). However, since the output stage of the secondary circuitry 505*b* includes two differential comparators 560*a*, 560*b*, the interference voltage caused by the common mode magnetic field is effectively eliminated. Specifically, the output stage of the secondary circuitry 505*b* provides the interference voltage to both the positive and negative inputs of the output comparator 560*b*, thereby canceling the disadvantageous effects of the interference voltage on the output voltage signal (R").

As described above, the magnetic mode interference may be more effectively canceled by arranging the primary windings (A), (B) and the secondary windings (C), (D) adjacent to one another on respective layers of the planar medium. However, it should be appreciated that the primary windings (A), (B) and the secondary windings (C), (D) may be arranged at a distance from one another, if a particular application of the present invention does not require the compensation of effects caused by common mode magnetic field interference.

It should also be appreciated that, although the operation of the exemplary planar transformer arrangement 500 is described only for generating output voltage signal (R") from input voltage signal (QR'), the exemplary planar transformer arrangement 500 operates similarly to produce output signal (S") from input signal (QS'), output signal (R') from input signal (QR"), and output signal (S') from input signal (QS"). In this manner, the exemplary planar transformer arrangement 500 may operate as a transceiver between the primary and secondary circuits 505*a*, 505*b*.

Figure 4A:
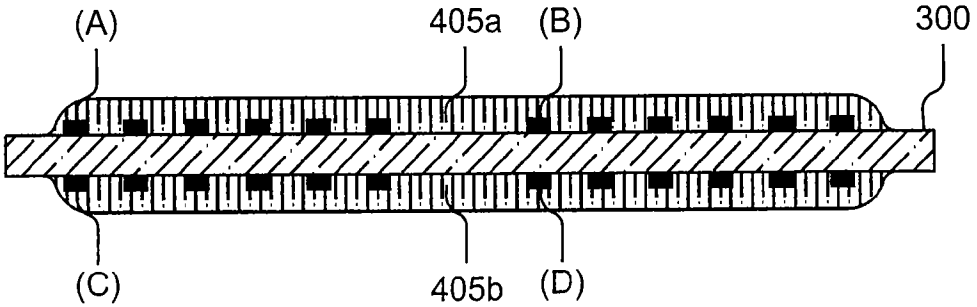
FIGS. 4*a* and 4*b* are exemplary planar transformer arrangements provided with a magnetic core according to the present invention.
Figure 4B:
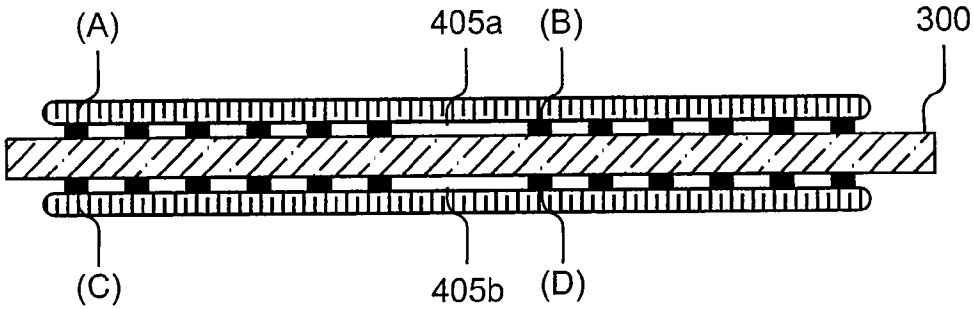

Referring now to FIGS. 4*a* and 4*b*, there is seen two variants, respectively, of the exemplary planar transformer arrangement 500 shown in FIGS. 5 through 6*c*. In these exemplary embodiments, the primary windings (A), (B) of planar transformers 605*a*, 605*b* and the secondary windings (C), (D) of planar transformers 605*a*, 605*b* are provided with respective magnetic cores 405*a*, 405*b* (e.g., ferrite) for magnetically coupling the respective windings (A), (B), (C), (D). In this manner, the two windings (A) and (C) of the first planar transformer 605*a* are coupled through both magnetic cores 405*a*, 405*b* and through the open magnetic circuit (e.g., 25 kv/mm) provided by the planar medium 300. Likewise, the two windings (B) and (D) of the second planar transformer 605*b* are coupled by the same two magnetic cores 405*a*, 405*b* and by the open magnetic circuit provided by the planar medium 300.

Figure 7A:
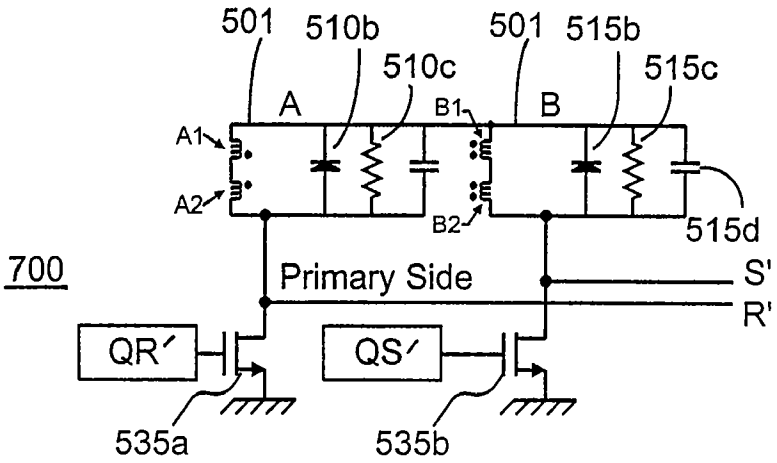
FIGS. 7*a* through 7*c* illustrates yet another exemplary planar transformer arrangement according to the present invention.
Figure 7B:
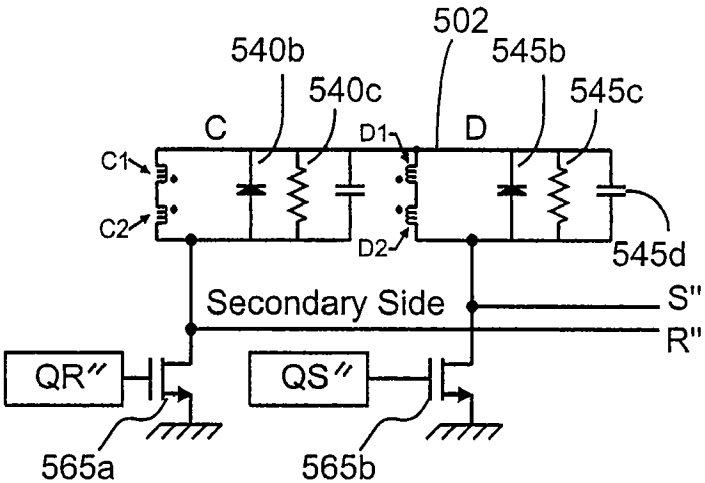
Figure 7B:
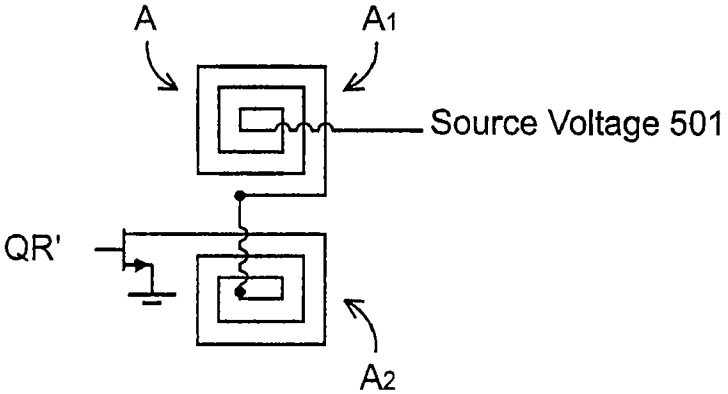
Figure 7C:
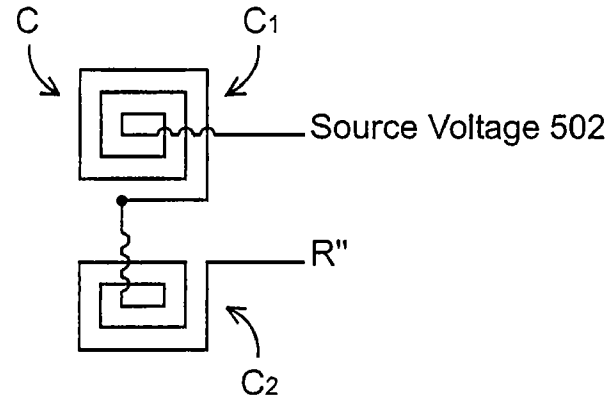

Referring now to FIGS. 7*a* through 7*c*, there is seen a third exemplary planar transformer arrangement 700 according to the present invention. In this exemplary embodiment, disadvantageous mode interference is canceled without need for the differential comparators 530*a*, 530*b*, 560*a*, 560*b* of FIG. 5. For this purpose, each of the primary windings (A), (B) and secondary windings (C), (D) is formed from two sub-windings connected in anti-series. Specifically, primary winding (A) is formed from two sub-windings ($A_1$), ($A_2$) connected in anti-series, primary winding (B) is formed from two sub-windings ($B_1$), ($B_2$) connected in anti-series, secondary winding (C) is formed from two sub-windings ($C_1$), ($C_2$) connected in anti-series, and secondary winding (D) is formed from two sub-windings ($D_1$), ($D_2$) connected in anti-series.

Figure 8B:
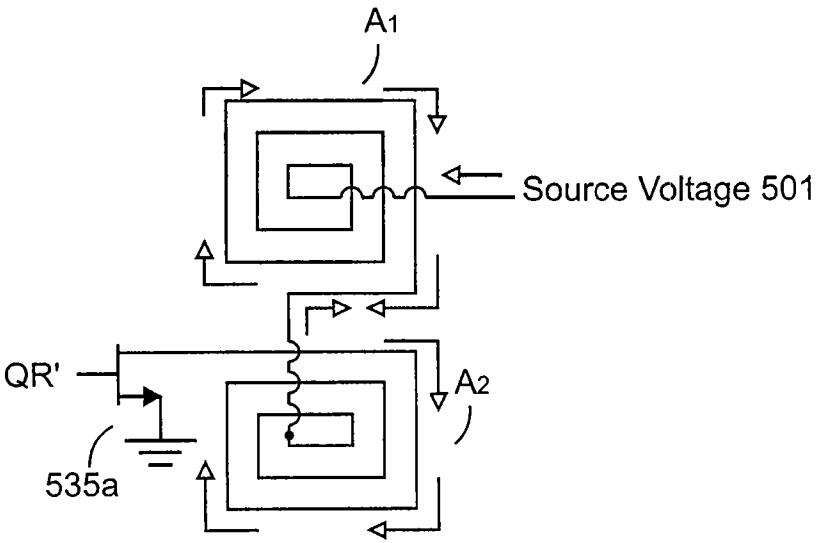
FIGS. 8*a* and 8*b* illustrate a primary winding connected in anti-series according to the present invention.
Figure 8A:
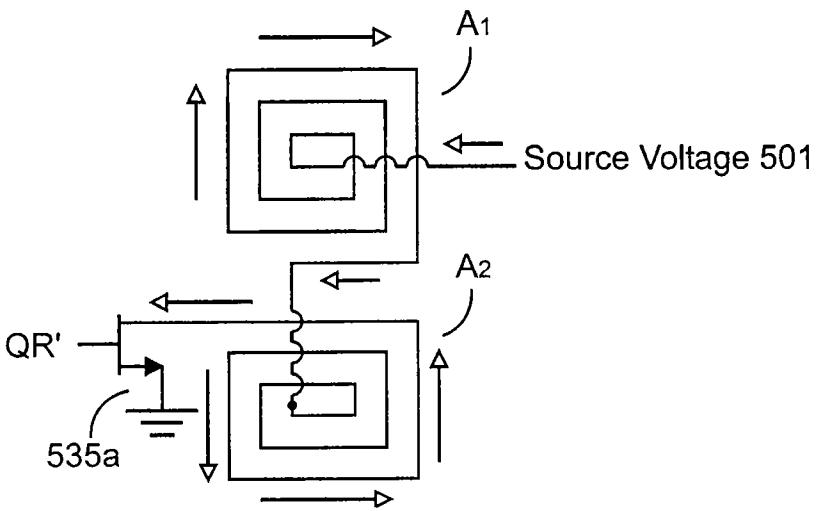

In operation, the third exemplary planar transformer arrangement 700 operates similarly to the exemplary planar transformer arrangement 500 of FIG. 5. For example, if a pulsed input signal (QR') is applied to the gate of FET 535*a* of primary circuitry 505*a*, a current will be induced within the sub-windings ($A_1$), ($A_2$) of the primary winding (A), as shown in FIG. 8*a*. The magnetic flux caused by the increasing current flow induces a voltage across the sub-windings ($C_1$), ($C_2$) of the secondary winding (C), which is output as a positive output voltage signal (R").

If a common mode magnetic field (e.g., noise caused by an external magnetic field) is applied, for example, to primary winding (A), the field will cause a current to flow within the primary winding (A). However, unlike the embodiment shown in FIG. 5, since the sub-windings ($A_1$), ($A_2$) of the primary winding (A) are connected in anti-series, the externally applied magnetic field will induce the flow of equal currents in opposite directions through each of the sub-windings ($A_1$), ($A_2$), thereby canceling the effects of the common mode interference effects, as shown in FIG. 7*b*. In this manner, no interference voltages are generated and, as such, no additional circuitry is required to compensate for the effects of the common mode magnetic field.

Figure 9:
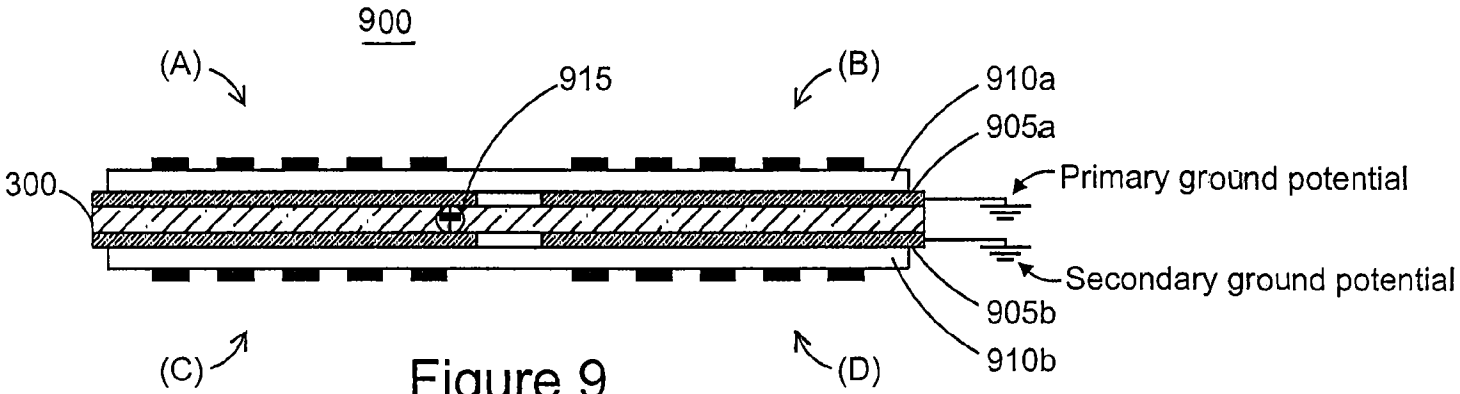
FIG. 9 illustrates another exemplary planar transformer arrangement provided with metallic shields according to the present invention.
Figure 10:
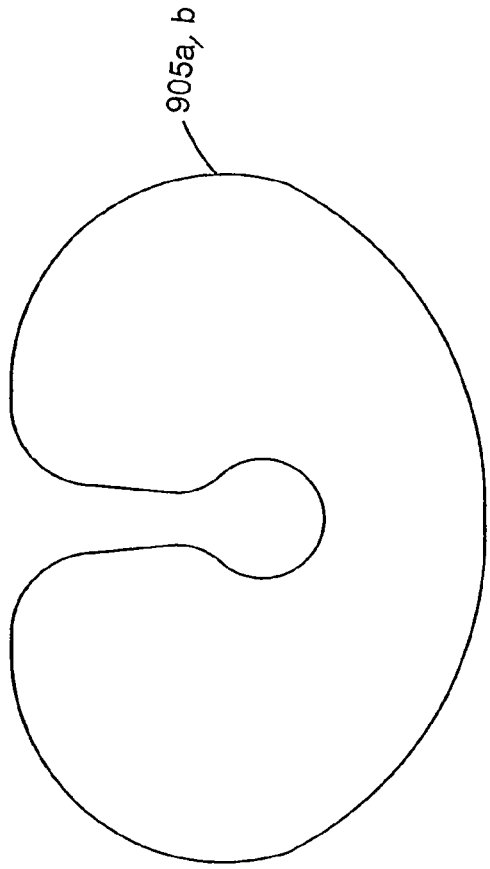
FIG. 10 is a top view of a metallic shield illustrated in FIG. 9.

To help compensate for a noise interference caused by parasitic capacitance, metallic shields may be provided between the windings and the planar medium 300. Referring now to FIG. 9, there is seen an exemplary planar transformer arrangement 900, including respective metallic shields 905*a*, 905*b* respectively connected to primary and secondary ground voltages. Transformer arrangement 900 is arranged between the planar medium 300 and respective windings (A), (B) and (C), (D). To electrically isolate the windings (A), (B), (C), (D) from the grounded shields 905*a*, 905*b*, respective insulator layers 910*a*, 910*b* are arranged between the shields 905*a*, 905*b* and the respective windings (A), (B) and (C), (D). Furthermore, to prevent current circulation in the metallic shields 905*a*, 905*b*, a slit may be cut into the shields 905*a*, 905*b*, as shown in FIG. 10.

By arranging the metallic shields 905*a*, 905*b* in this fashion, the interwinding parasitic capacitance 915 is located between the metallic shields 905*a*, 905*b* and, in this manner, the interwinding parasitic capacitance is better prevented from interfering with the planar transformers 605*a*, 605*b*, since the two shields 905*a*, 905*b* operate to magnetically isolate the magnetic flux produced by the interwinding parasitic capacitance 915.

Although the present invention has been described in relation to particular embodiments thereof, many other variations and modifications and other uses will become apparent to those skilled in the art. It is preferred, therefore, that the present invention not be limited by the specific disclosure herein.

What is claimed is:

1. A mode elimination transformer to reduce a common mode interference caused by a common mode magnetic field, said mode elimination transformer comprising:

a first comparison circuit to subtract a first primary inductance of a first primary winding from a second primary inductance of a second primary winding;

a second comparison circuit to subtract a first secondary inductance of a first secondary winding from a second secondary inductance of a second secondary winding;

said first comparison circuit and said second comparison circuit configured to reduce said common mode interference voltage.

2. The mode elimination transformer of claim 1, wherein:

said first primary winding resides adjacent to said first secondary winding; and said first secondary winding resides adjacent to said second secondary winding.

3. The mode elimination transformer of claim 1, wherein said first comparison circuit resides on a first planar medium, and said second comparison circuit resides on a second planar medium.

4. The mode elimination transformer of claim 3, wherein said first planar medium and said second planar medium are separated by a dielectric layer.

5. The mode elimination transformer of claim 1, wherein said first comparison circuit resides on a first side of a general interlayer structure, and said second comparison circuit resides on a second side of said interlayer structure.

6. The mode elimination transformer of claim 1, wherein said first comparison circuit and said second comparison circuit reside on a semiconductor die.

7. The mode elimination transformer of claim 1, wherein said first comparison circuit and said second comparison circuit reside on opposing surfaces of a semiconductor die.

8. The mode elimination transformer of claim 1, wherein:

said first primary winding comprises a meandering trace;

said second primary winding comprises a meandering trace;

said first secondary winding comprises a meandering trace; and said second secondary winding comprises a meandering trace.

9. The mode elimination transformer of claim 1, wherein:

said first comparison circuit comprises a first primary comparator and a second primary comparator;

said second comparison circuit comprises a first secondary comparator and a second secondary comparator.

10. The mode elimination transformer of claim 1, wherein:

said first comparison circuit comprises a first primary differential amplifier and a second primary differential amplifier;

said second comparison circuit comprises a first secondary differential amplifier and a second secondary differential amplifier.

11. The mode elimination transformer of claim 1, wherein said mode elimination transformer is adapted to function as a transceiver.

12. A mode elimination transformer to reduce a common mode interference caused by a common mode magnetic field, said mode elimination transformer comprising:

a first comparison circuit on a first planar medium, said first comparison circuit comprising a first pair of differential amplifiers to subtract a first primary inductance of a first primary winding from a second primary inductance of a second primary winding;

a second comparison circuit on a second planar medium, said second comparison circuit comprising a second pair of differential amplifiers to subtract a first secondary inductance of a first secondary winding from a second secondary inductance of a second secondary winding;

said first comparison circuit and said second comparison circuit configured to limit said common mode interference voltage.

13. The mode elimination transformer of claim 12, wherein said first planar medium and said second planar medium reside on opposing surfaces of a semiconductor die.

14. The mode elimination transformer of claim 13, wherein:

said first primary winding resides substantially over first secondary winding;

said second primary winding resides substantially over second secondary winding.

15. The mode elimination transformer of claim 12, wherein:

said first comparison circuit further comprises a first resistor network to subtract a first primary voltage from a second primary voltage;

said second comparison circuit further comprises a second resistor network to subtract a first secondary voltage from a second secondary voltage.

16. The mode elimination transformer of claim 15, wherein said first resistor network comprises a first voltage divider network and said second resistor network comprises a second voltage divider network.

17. The mode elimination transformer of claim 12, further comprising at least one input on said first planar medium and at least one output on said second planar medium, wherein said at least one output corresponds to said at least one input.

18. The mode elimination transformer of claim 12, wherein said mode elimination transformer is adapted to function as a transceiver.

* * * * *